US007621421B2

(12) United States Patent
Ohayon

(10) Patent No.: US 7,621,421 B2
(45) Date of Patent: Nov. 24, 2009

(54) VARIABLY CONFIGURABLE STACKABLE BINS

(76) Inventor: Abraham Ohayon, 1345 E. 38th St., Brooklyn, NY (US) 11234

( * ) Notice: Subject to any disclaimer, the term of this patent is extended or adjusted under 35 U.S.C. 154(b) by 565 days.

(21) Appl. No.: 11/328,573

(22) Filed: Jan. 10, 2006

(65) Prior Publication Data

US 2007/0158347 A1 Jul. 12, 2007

(51) Int. Cl.
*B65D 25/04* (2006.01)
*B65D 21/02* (2006.01)
*B65D 21/032* (2006.01)

(52) U.S. Cl. ..... 220/529; 220/23.6; 206/509

(58) Field of Classification Search ..... 220/552, 220/533, 532, 529, 23.2, 500; 206/504, 505, 206/507; D21/500, 499
See application file for complete search history.

(56) References Cited

U.S. PATENT DOCUMENTS 1,630,140 A * 5/1927 Sibbald ..... 220/552
2,081,078 A * 5/1937 Watson ..... 126/373.1
3,194,426 A * 7/1965 Brown, Jr. ..... 220/23.4
3,346,137 A * 10/1967 Ricci ..... 220/23.6
3,455,480 A * 7/1969 Mitchell et al. ..... 220/23.4
3,491,896 A * 1/1970 Crary ..... 108/60
3,656,650 A * 4/1972 Frater ..... 220/533
3,749,273 A * 7/1973 Wreghitt et al. ..... 220/1.5
4,192,562 A * 3/1980 Bishoff et al. ..... 312/108
4,470,647 A * 9/1984 Bishoff et al. ..... 312/111
4,592,601 A * 6/1986 Hlinsky et al. ..... 312/111
5,050,755 A * 9/1991 Strawder ..... 220/23.4
5,148,942 A * 9/1992 Snook ..... 220/533
5,310,071 A * 5/1994 Rivlin et al. ..... 220/23.4
5,339,979 A * 8/1994 Box ..... 220/529
5,593,037 A * 1/1997 Ohayon ..... 206/509
5,888,114 A * 3/1999 Slocum et al. ..... 446/128
D411,768 S * 7/1999 Woodring ..... D3/314
D421,335 S * 3/2000 Linard ..... D3/314
6,062,388 A * 5/2000 Ohayon ..... 206/509
D430,231 S * 8/2000 Sorensen et al. ..... D21/500
D435,609 S * 12/2000 Sorensen ..... D21/499
6,276,550 B1 * 8/2001 Cherrington ..... 220/23.4
6,557,955 B2 * 5/2003 Saravis ..... 312/111
2006/0049075 A1 * 3/2006 Chen ..... 206/504

* cited by examiner

*Primary Examiner*—Anthony D Stashick
*Assistant Examiner*—Robert J Hicks
(74) *Attorney, Agent, or Firm*—Frishauf, Holtz, Goodman & Chick, P.C.

(57) ABSTRACT

Stackable bin includes a housing defining a receptacle and having two pair of opposed walls defining an opening at a front leading into the receptacle, at least one pair of which have an inward taper with respect to a central axis of the housing. A partitioning structure is removably insertable into the receptacle through the opening and partitions the receptacle into a plurality of storage compartments. The partitioning structure has an inward taper corresponding to the inward taper of the opposed walls and frictionally engages the opposed walls to hinder unintentional removal of the partitioning structure from the receptacle. The removability of the partitioning structure enables the receptacle to be selectively partitioned into smaller storage spaces than a storage space without the partitioning structure which would occupy the entire receptacle. Use of the partitioning structure would be dependent on the objects sought to be stored by the user.

20 Claims, 7 Drawing Sheets

10
12
14
16
20
22
24
26
28
30
32
38
40
48
50
52
54
56
58
60
62
64
66
68
70
72
74
76
78

VARIABLY CONFIGURABLE STACKABLE BINS

FIELD OF THE INVENTION

The present invention relates generally to stackable bins and more particularly to stackable storage bins capable of being configured differently to provide variably dimensioned storage compartments.

BACKGROUND OF THE INVENTION

Stackable bins for holding articles are well known. For example, stackable bins have been proposed by the same inventor herein, and which are the subject matter of U.S. Pat. No. 5,593,037, issued Jan. 14, 1997, and U.S. Pat. No. 6,062,388, issued May 16, 2000, the entire disclosures of which are incorporated herein by reference.

According to the '037 patent, a stackable bin is provided having reinforcing ribs that perform a two-fold function of reinforcing the walls while also supporting the bin in a stacked arrangement, and in which there is a reliable interlocking arrangement of the bins in the stacked configuration thereof. The bins proposed in the '037 patent have a central partition wall which supports the bins in a stacked relation, divides each bin into two compartments, increases the structural integrity of each bin and locks the bins in a stacked relation. A problem occurs, however, if the bins have a small dimension without the central partition wall. Specifically, inner pressure from the goods in a stacked bin may cause the front ends of the side walls of the bin to move outwardly. This, in turn, can cause instability in the top bin, since the bottom of the top bin stacked thereon could fall down within the side walls of the lower bin.

According to the '388 patent, a stackable bin is provided which includes two spaced apart side walls and a rear wall having opposite side edges connecting rear edges of the side walls together. The side and rear walls are slightly inclined inwardly with respect to a vertical plane such that lower edges of the side and rear wall fit within upper edges of side and rear walls of a lower stackable bin. A bottom wall is connected to lower portions of the side and rear walls. Vertically oriented ribs are arranged on outer surfaces adjacent front and rear edges of the side walls for supporting the stackable bin on the upper edges of the side walls of the lower bin and for increasing structural rigidity of the side walls. At least some ribs include a notch in a lower end to receive the upper edges of the side walls of the lower bin and an outer interlocking tab at a lower end which engages outer surfaces of the side walls of the lower bin when the upper edges of the side walls of the lower bin are received in the notches. In this manner, the side walls of the lower bin are maintained in alignment and outward movement thereof is prevented.

The stackable bins in the '037 patent and the '388 patent generally do not enable easy variations in the size of the storage compartments defined by the bins.

Therefore, the same inventor herein has proposed stackable bins which enable different configurations of storage compartments to be defined thereby. Such stackable bins are the subject matter of U.S. patent application Ser. No. 10/861,754 filed Jun. 3, 2004 and U.S. patent application Ser. No. 10/903,284 filed Jul. 29, 2004, the entire disclosures of which are incorporated herein by reference.

According to the '754 and '284 applications, a stackable bin is provided having a case including a bottom wall, a top wall and a support mechanism for supporting the top wall at a distance from the bottom wall to thereby define a slot. A drawer is insertable into the slot and defines a receptacle capable of receiving objects for storage. A partitioning structure is provided to selectively partition the receptacle into smaller storage compartments. Variations in the partitioning structure enable different sizes and configurations of storage compartments.

More particularly, the partitioning structure includes divider guides arranged on the interior of front, rear and side walls of the drawer and dividers removably insertable between the divider guides. Dividers which are insertable into the divider guides on the front and rear walls partition the receptacle lengthwise while dividers which are insertable into the divider guides on the side walls partition the receptacle crosswise. The dividers include slots to enable both a lengthwise and crosswise partitioning of the receptacle.

Since the receptacle defining the storage compartment(s) in the stackable bins in the '754 and '284 applications is defined by a drawer, removal of the drawer from the bin is generally required in order to access a storage compartment. Although this construction inhibits the contents of the storage compartment(s) from falling out of the bins, at times, a stackable bin which provides easier access to storage compartments is desired.

SUMMARY OF THE INVENTION

It is an object of the present invention to provide a new stackable bin having a storage space capable of being configured differently to provide variably dimensioned storage compartments.

Another object of the present invention is to provide a new stackable bin with a variably configurable storage space which is easily accessible.

The above-mentioned objects and other objects of the present invention are attained in accordance with the stackable bin configuration of the present invention which is described hereinafter.

A stackable bin in accordance with one embodiment of the invention includes a housing defining a receptacle and including two pair of opposed walls defining an opening at a front leading into the receptacle, at least one pair of which have an inward taper with respect to a central axis of the housing. The bin also includes a partitioning structure removably insertable into the receptacle through the opening and which, when present in the receptacle, partitions the receptacle into a plurality of storage compartments. The partitioning structure has an inward taper corresponding to the inward taper of the opposed walls and slightly frictionally engages the opposed walls to hinder unintentional removal of the partitioning structure from the receptacle. The removability of the partitioning structure enables the receptacle to be selectively partitioned into storage spaces which are smaller than a storage space without the partitioning structure, which would occupy the entire receptacle. Use of the partitioning structure would be dependent on the objects sought to be stored in the bin by the user.

To enable mating of multiple bins, i.e., vertical stacking and/or a horizontal side-by-side arrangement, a first wall in one or each pair of opposed walls has an outward facing stepped profile on an outer surface and a second wall in the same pair has an inward facing stepped profile on an outer surface which mates with the outward facing stepped profile. Mating is provided by orienting two bins such that a first wall with the outward facing stepped profile of one bin is adjacent a second wall with the inward facing stepped profile of another bin and bringing them together until the profiles engage one another.

The outward facing stepped profile may include an outer raised ledge formed on an outer surface of the first wall extending along the entire periphery thereof and an inner raised ledge formed on and projecting from the outer raised ledge and extending along the entire periphery thereof. The inward facing stepped profile may include a raised ledge formed on an outer surface of the second wall extending along the entire periphery thereof and an inwardly facing indentation formed in the ledge and extending along the entire periphery thereof.

If a rectangular-bin having four walls is provided, an adjacent pair of walls is provided with the outward facing stepped profile and the other adjacent pair of walls is provided with the inward facing stepped profile. This enables both vertical stacking and horizontal side-by-side arrangement of the bins.

The partitioning structure may include a vertical divider and a horizontal divider which mate with one another by means of slots formed on each divider. Guide mechanisms are provided to guide the insertion of the dividers into the receptacle and into mating position with one another.

Another embodiment of a stackable bin in accordance with the invention includes a housing defining a receptacle and including two pair of opposed walls defining an opening at a front leading into the receptacle. A first wall in each pair of opposed walls has an outward facing stepped profile on an outer surface and a second wall in each pair has an inward facing stepped profile on an outer surface which mates with the outward facing stepped profile to thereby enable a plurality of the bins to be mated together vertically or horizontally via mating of the walls. The tapering of the walls and partitioning structure described above can be used in this embodiment, as well as other features of the embodiment described above.

BRIEF DESCRIPTION OF THE DRAWINGS

The invention, together with further objects, and advantages thereof, may best be understood by reference to the following description taken in conjunction with the accompanying drawings, wherein like reference numerals identify like elements.

DETAILED DESCRIPTION OF THE INVENTION

Figure 1:
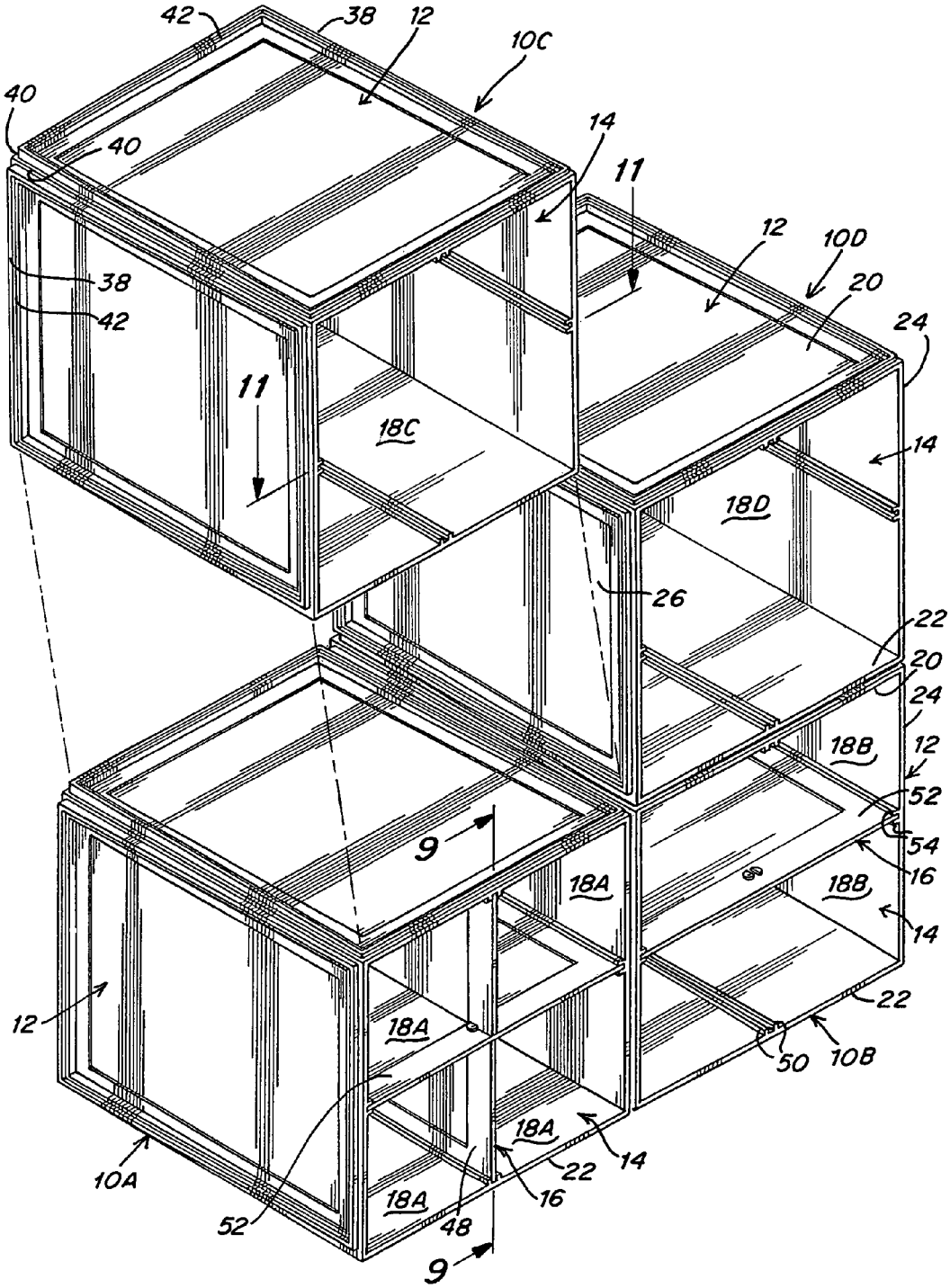
FIG. 1 is an exploded perspective view of a stacked group of stackable bins according to the present invention, and showing different configurations of storage compartments.

Referring to the accompanying drawings wherein like reference numerals refer to the same or similar elements, FIG. 1 show a group of four stacked bins 10A, 10B, 10C and 10D in accordance with the invention arranged in a 2×2 array. Each bin 10A, 10B, 10C and 10D includes an outer housing 12 defining a storage space 14 and can optionally include a removable partitioning structure 16 arranged in the storage space 14 and having one of a plurality of different configurations to selectively partition the storage space 14 into a plurality of separated storage compartments 18. Although partitioning structure 16 would be provided as part of a bin in accordance with the invention, a user can elect not to use it if the largest storage space is sought.

In one configuration of the partitioning structure 16 shown in bin 10A, the storage space 14 is partitioned into four storage compartments 18A. In another configuration shown in bin 10B, the storage space 14 is partitioned into two, horizontally elongated storage compartments 18B, one on top of the other. Bins 10C and 10D do not include partitioning structure 16 in any of its configurations, so that a single storage compartment 18C, 18D coextensive with the storage space 14 is formed.

Use of the partitioning structure 16 in any particular bin 10A, 10B, 10C and 10D and the configuration of the partitioning structure 16 when used in any bin 10A, 10B, 10C and 10D is freely selectable by the user. As such, numerous different configurations of storage compartments can be formed using the four stackable bins 10A, 10B, 10C and 10D shown in FIG. 1.

Moreover, in view of the stackability of the bins 10A, 10B, 10C and 10D (the features which enable such stackability being described below), they may be arranged in different vertical configurations, e.g., a 1-2-1 array, a 1-3 array and a 1-1-2 array. Accordingly, the possibilities for creating different storage arrangements using a plurality of stackable bins in accordance with the invention with variably configurable storage spaces are numerous.

Referring now to FIGS. 2-11B in which reference numeral 10 will designate a stackable bin in accordance with the invention, the housing 12 of the bin 10 is formed as a homogeneous, uniform and one piece plastic material. Housing 12 includes a substantially planar top wall 20, a substantially planar bottom wall 22 and substantially planar side walls 24, 26. Although as shown the top wall 20, bottom wall 22 and side walls 24, 26 have a generally rectangular shape, the present invention is not limited to this particular shape.

Figures 9, 9A, 9B:
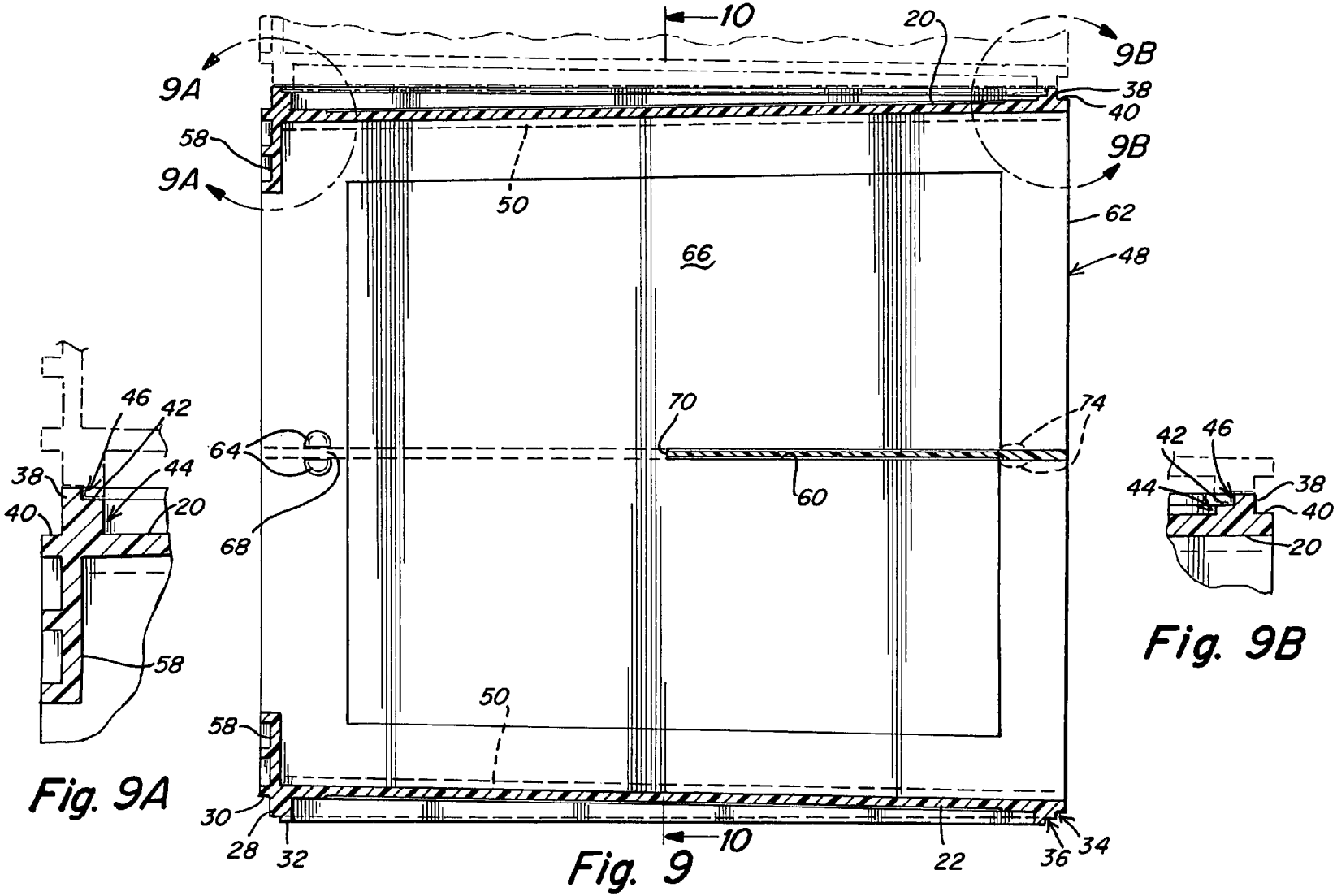
FIG. 9 is a cross-sectional side view of the bin including the set of dividers taken along the line 9-9 of FIG. 1.
FIG. 9A is an enlarged, fragmentary view of the area encircled by arrows 9A-9A in FIG. 9.
FIG. 9B is an enlarged, fragmentary view of the area encircled by arrows 9B-9B in FIG. 9.
Figures 11, 11A, 11B:
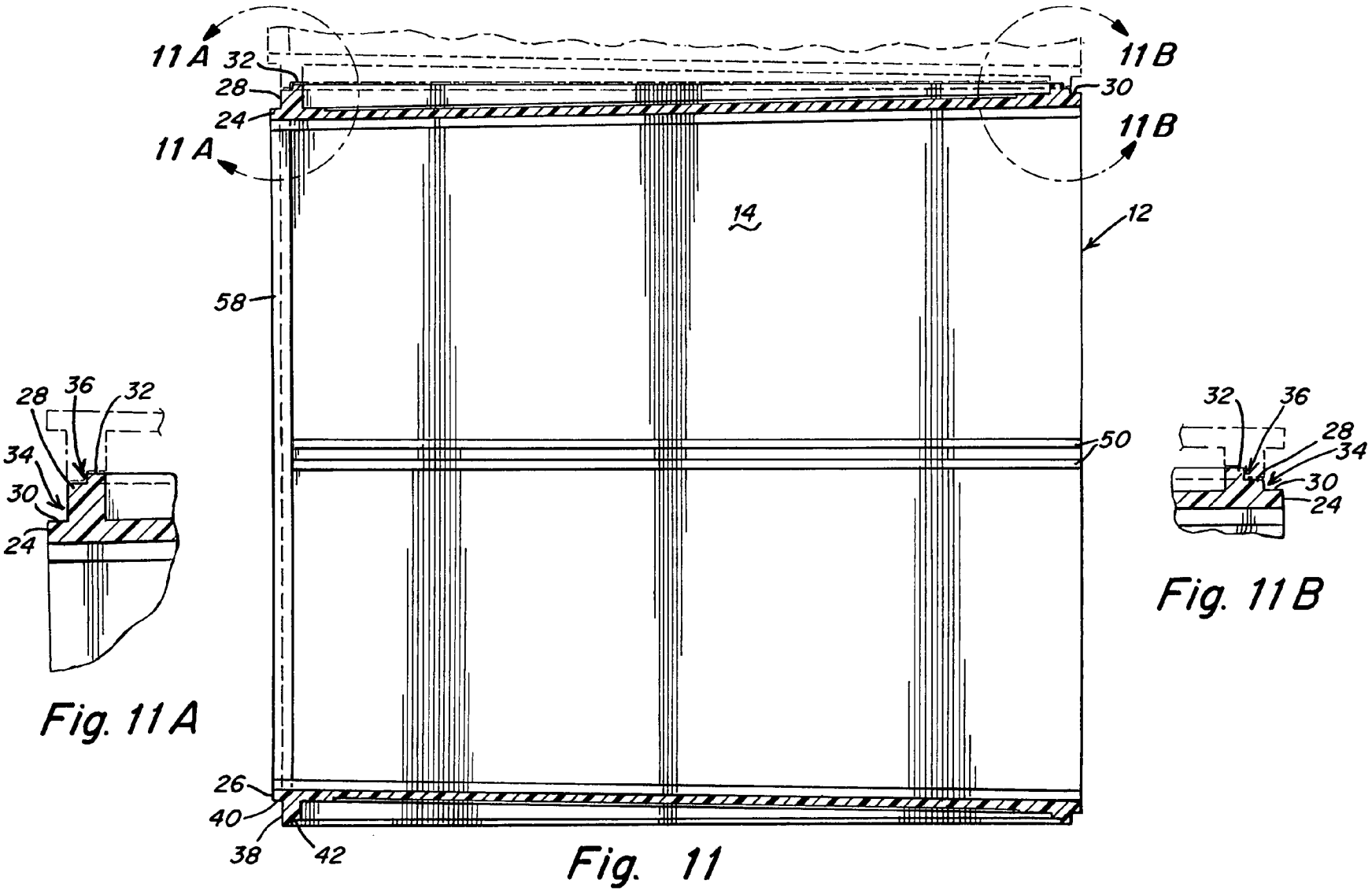
FIG. 11 is a cross-sectional plan view of the bin without the set of dividers taken along the line 11-11 of FIG. 1.
FIG. 11A is an enlarged, fragmentary view of the area encircled by arrows 11A-11A in FIG. 11.
FIG. 11B is an enlarged, fragmentary view of the area encircled by arrows 11B-11B in FIG. 11.

Top, bottom and side walls 20, 22, 24, 26 taper inward from the front of the bin 10 to the rear of the bin 10 with respect to a central axis of the housing 12 (see FIG. 9 wherein the inward tapering of the top and bottom walls 20, 22 is shown and FIG. 11 wherein the inward tapering of the side walls 24, 26 is shown). This inward tapering results in the distance between the top and bottom walls 20, 22 and the distance between the side walls 24, 26 decreasing toward the rear of the bin 10 and is used to retain the partitioning structure 16 as described more fully below. The inward tapering may be provided in the entire wall 20, 22, 24, 26 or over only a portion thereof.

To enable a plurality of bins 10 to be stacked on top of one another and mated side by side with one another in a secure manner and in alignment with one another, a unique multi-level or multi-step positioning arrangement is used. In this arrangement, an outer raised ledge 28 is formed on the outer surface 30 of two adjacent walls of the bin 10 (the bottom and side walls 22, 24 in the illustrated embodiment) and each extends along the entire periphery of the respective wall 22, 24, slightly inward from the edges of the wall 22, 24. In view of the tapering of the walls 22, 24, each outer raised ledge 28 has a variable height along the side edges of the wall 22, 24 (increasing in the rearward direction as shown in FIGS. 5-8) but a substantially constant height along the front and rear edges of the wall 22, 24 (see FIGS. 3 and 4).

Each outer raised ledge 28 has a substantially planar upper surface on which an inner raised ledge 32 is formed. Each inner raised ledge 32 extends along the entire periphery of the outer raised ledge 28, slightly inward from the edges of the outer raised ledge 28. Each inner raised ledge 32 has a substantially constant height along the edges of the outer raised ledge 28. The width of the inner raised ledge 32 may be about one-half of the width of the outer raised ledge 28 (see FIGS. 11A and 11B).

Figure 10:
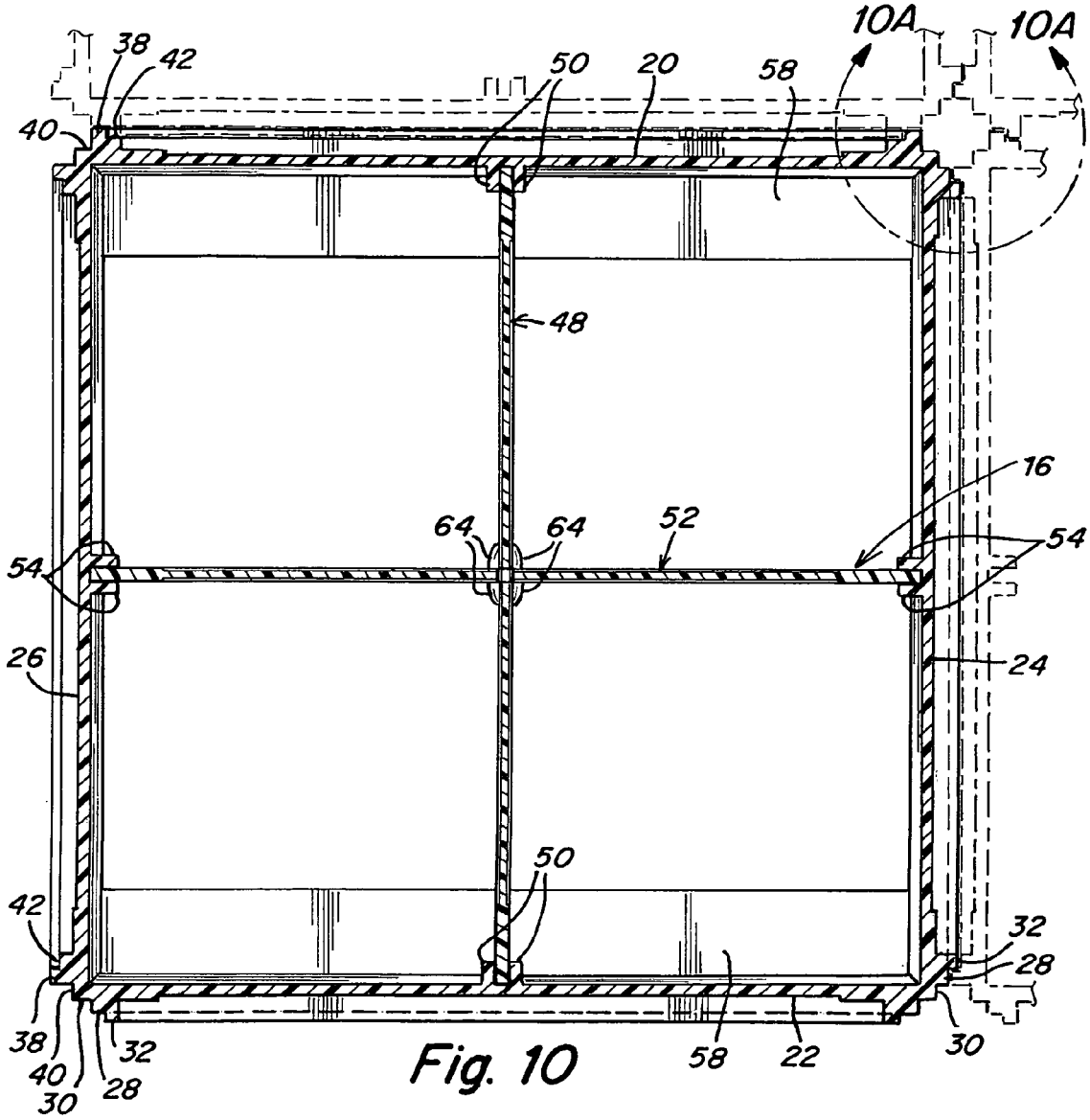
FIG. 10 is a cross-sectional front view of the bin including the set of dividers taken along the line 10-10 of FIG. 9.
Figure 10A:
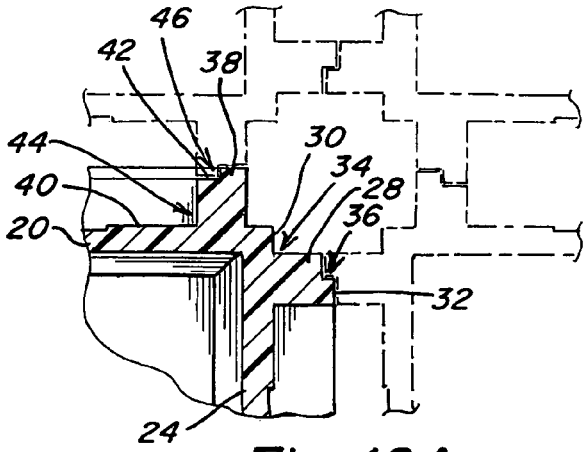
FIG. 10A is an enlarged, fragmentary view of the area encircled by arrows 10A-10A in FIG. 10.

Formation of the outer and inner raised ledge 28, 32 above the outer surface 30 of the bottom wall 22 and side wall 24 provides these walls with an outward facing stepped profile, i.e., two discrete vertical steps or separations are provided. One vertical step 34 is between the outer surface 30 of the bottom wall 22 or side wall 24 and the outer raised ledge 28 and the other vertical step 36 is between the outer raised ledge 28 and the inner raised ledge 32 (see FIGS. 10A, 11A and 11B). In view of the variation in the height of outer raised ledge 28 relative to the outer surface 30 of the bottom and side walls 22, 24, step 34 has a variable height (compare FIG. 11A and FIG. 11B) while step 34 has a substantially constant height in view of the constant height of inner raised ledge 32 on outer raised ledge 28.

On the outer surface of the other two adjacent walls of the bin 10 (top and side walls 20, 26 in the illustrated embodiment), the positioning arrangement includes receiving structure which is designed to securely receive the inner raised ledge 32 formed on bottom and side walls 22, 24. To this end, a raised ledge 38 is formed on the outer surface 40 of the two adjacent walls 20, 26 of the bin 10 and each extends along the entire periphery of the respective wall 20, 26, slightly inward from the edges of the wall 20, 26. In view of the tapering of the walls 20, 26, each ledge 38 has a variable height along the side edges of the wall 20, 26 (see FIGS. 5-8) but a substantially constant height along the front and rear edges of the wall 20, 26 (see FIGS. 3 and 4).

Each ledge 38 has a substantially planar upper surface in which an indentation 42 is formed. Each indentation 42 extends along the entire periphery of the ledge 38, slightly inward from the edges thereof. Each indentation 42 has a substantially constant height along the edges of the ledge 38. The width of the indentation 42 may be about one-half of the width of the ledge 38.

Formation of the ledge 38 and indentation 42 above the outer surface 40 of the top and side walls 20, 26 provides these walls with an inward facing stepped profile, i.e., two discrete vertical steps or separations are provided. One vertical step 44 is between the outer surface 40 of the top or side wall 20, 26 and the indentation 42 and the other vertical step 46 is between the ledge 38 and the indentation 42 (see FIGS. 9A, 9B and 10). In view of the variation in the height of ledge 38 relative to the outer surface 40 of the top and side walls 20, 26, step 44 has a variable height (compare FIG. 9A and FIG. 9B) while step 46 has a substantially constant height in view of the constant height (depth) of indentation 42 along the ledge 38.

Mating of two bins 10 can be effected by placing a wall of a first bin having the outward facing stepped profile against a wall of a second bin having the inward facing stepped profile. Thus, either a horizontal orientation of the two bins 10 can be provided by mating side wall 24 of one bin 10 to the side wall 26 of the other bin 10, or a vertical orientation can be provided by mating the top wall 20 of one bin 10 to the bottom wall 22 of the other bin 10. Moreover, although not preferred, it is possible to mate the side wall 24 of one bin 10 to the top wall 20 of the other bin or the side wall 26 of one bin 10 to the bottom wall 22 of the other bin 10.

In the mated position of two or more bins 10, shown in FIGS. 1 and 9-11B (in FIGS. 9-11B, the mating bins are shown in phantom), the inner raised ledge 32 of the outward facing stepped profile contacts the indentation 42 of the inward facing stepped profile while the outer raised ledge 28 contacts the ledge 38. Since the inner raised ledge 32 is arranged in the indentation 42 around its entire periphery, it is retained thereby to provide for a secure mating of the two bins 10 together (see FIGS. 9, 10 and 11).

Mating of more than two bins 10 together in a vertical orientation is obtained since the top and bottom walls 20, 22 having opposite stepped profiles. Thus, in a stack of three bins 10, the top wall 22 of the lowermost bin 10 is mated with the bottom wall 22 of a second, middle bin 10 and the top wall 20 of this second bin 10 is mated with the bottom wall 22 of a third, uppermost bin 10. Similarly, a horizontally oriented, side by side arrangement of two or more bins 10 is obtained since the side walls 24, 26 having opposite stepped profiles. Thus, in a row of three bins 10 placed side by side, the side wall 24 of the leftmost bin 10 is mated with the side wall 26 of a second, middle bin 10 and the side wall 24 of this second bin 10 is mated with the side wall 26 of a third, rightmost bin 10.

Moreover, it is possible to create mated groups of bins 10 with multiple bins 10 in both the horizontal and vertical directions such as shown in FIG. 1. In the group of bins 10 shown in FIG. 1, the top wall 20 of bin 10A is mated with the bottom wall 22 of bin 10C, the top wall 20 of bin 10B is mated with the bottom wall 22 of bin 10D, the side wall 24 of bin 10A is mated with the side wall 26 of bin 10B and the side wall 24 of bin 10C is mated with the side wall 26 of bin 10D.

Although the top and side walls 20, 26 are shown with the inward facing stepped profile and the bottom and side walls 22, 24 are shown with the outward facing stepped profile, it is possible to reverse the profiles on these walls. Also, it is possible to provide top and side walls 20, 24 with the same profile and bottom and side walls 22, 26 with the same profile. Formation of a particular stepped profile, i.e., the outward facing or inward facing stepped profile, on the walls of a bins can vary depending, for example, on the desired marketing parameters. Thus, a bin can be made with an outward facing stepped profile on three or four of its walls, or with an inward facing stepped profile on three or four of its walls. If applied to a bin with more than four walls, the walls of such a bin would preferably include an inward facing stepped profile on at lest two adjacent walls and an outward facing stepped profile on at least two other adjacent walls.

The partitioning structure 16 can take various forms. In the non-limiting illustrated embodiment, the partitioning structure 16 includes a first substantially planar divider 48 which is removably insertable into divider guides 50 on the inner surfaces of the top and bottom walls 20, 22 and a second substantially planar divider 52 which is removably insertable into divider guides 54 on the inner surfaces of the side walls 24, 26. Divider guides 50, 54 are a pair of longitudinally extending ribs spaced apart a distance equal to the width of an engaging divider 48 or 52.

Divider 48 is designed to slide into divider guides 50 to partition the receptacle 14 vertically. The rear edge of the divider 48 has indentations 56 at the corners to enable a remaining part of the rear edge to slide between transverse support panels 58 extending between the side walls 24, 26 at the rear of the bin 10. Divider 48 includes a slot 60 extending rearwardly from the front edge 62 and at a location in alignment with the divider guides 54 in the side walls 24, 26 when the divider 48 is placed in the receptacle 14 (see FIG. 2). Divider 48 also includes a pair of guide members 64 on side surfaces 66 close to the rear edge. In each pair, guide members 64 are spaced apart from one another to define a channel 68 therebetween which aligns with the slot 60.

Divider 52 is designed to slide into divider guides 54 to partition the receptacle 14 horizontally (see bin 10B in FIG. 1). Divider 52 includes a slot 70 extending forwardly from the rear edge 72 and at a location in alignment with the divider guides 50 in the top and bottom walls 20, 22 when the divider 52 is placed in the receptacle 14 (see FIG. 2). Divider 52 also includes a pair of guide members 74 on side surfaces 76 close to the front edge. In each pair, guide members 74 are spaced apart from one another to define a channel 78 therebetween which aligns with the slot 70.

In view of the inward angling of top and bottom walls 20, 22, the upper and lower edges of the divider 48 are tapered toward a central plane of the divider 48. Similarly, in view of the inward angling of side walls 24, 26, the side edges of the divider 52 are tapered toward a central plane of divider 52. This provides a snug fit for the dividers 48, 52 in the receptacle 14 which reduces the possibility of inadvertent and unintentional removal of the dividers 48, 52.

Figures 2, 3:
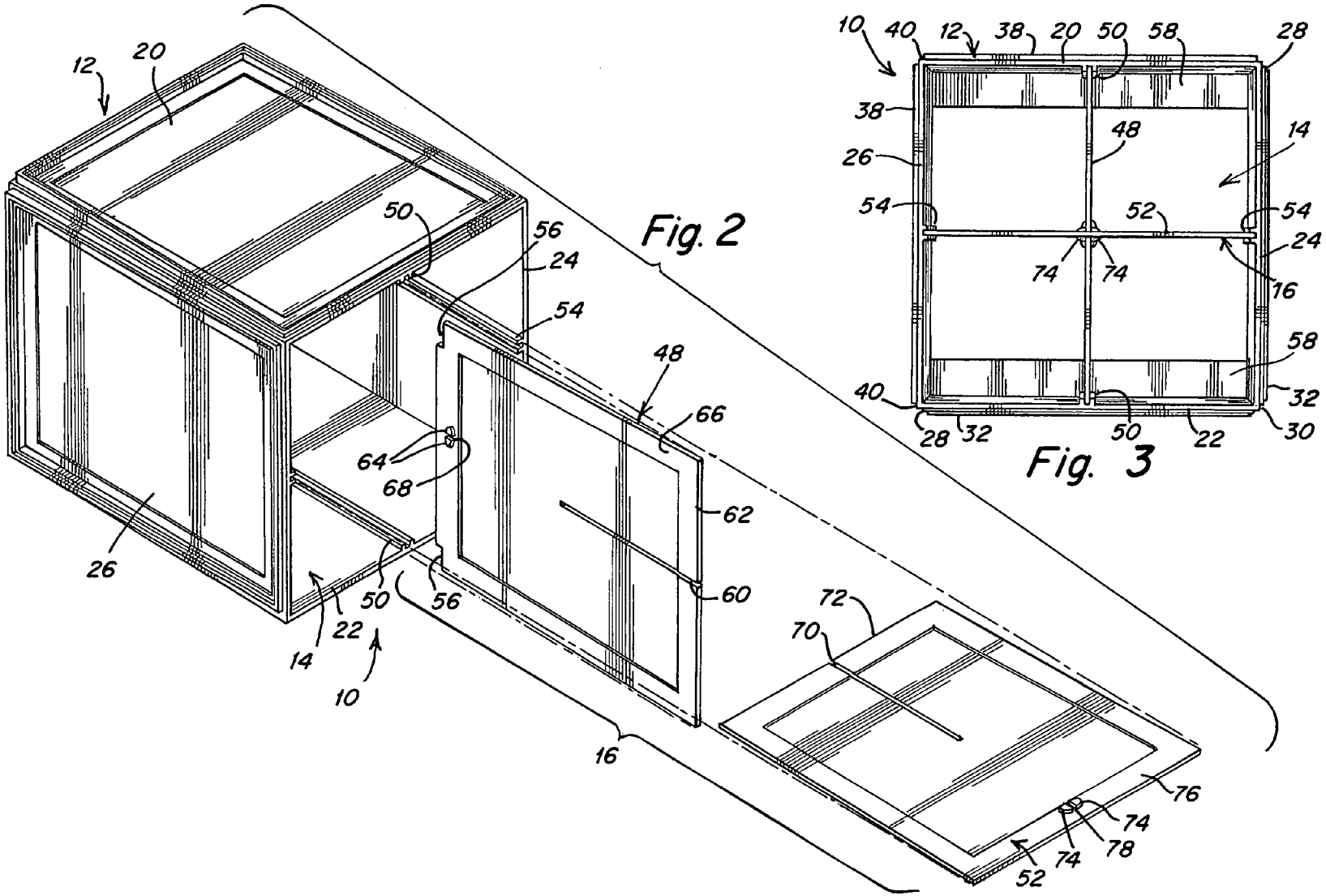
FIG. 2 is an exploded perspective view of a single stackable bin according to the present invention including a set of dividers.
FIG. 3 is a front elevational view of the bin including the set of dividers shown in FIG. 2.
Figure 4:
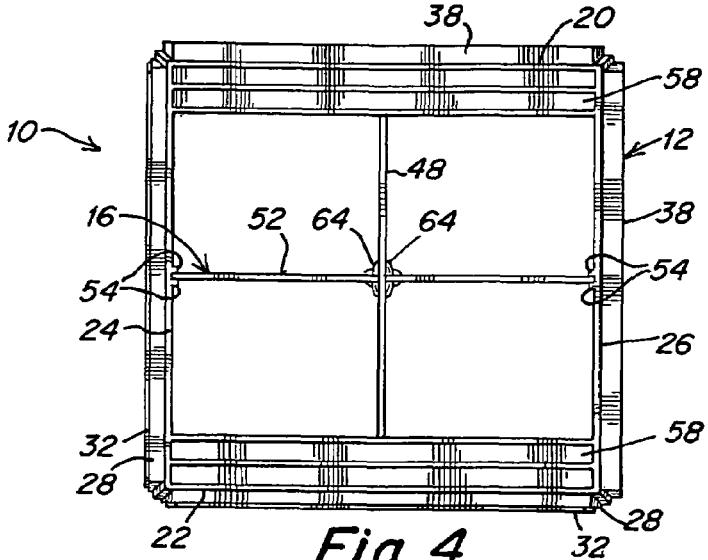
FIG. 4 is a rear elevational view of the bin including the set of dividers shown in FIG. 2.
Figure 5:
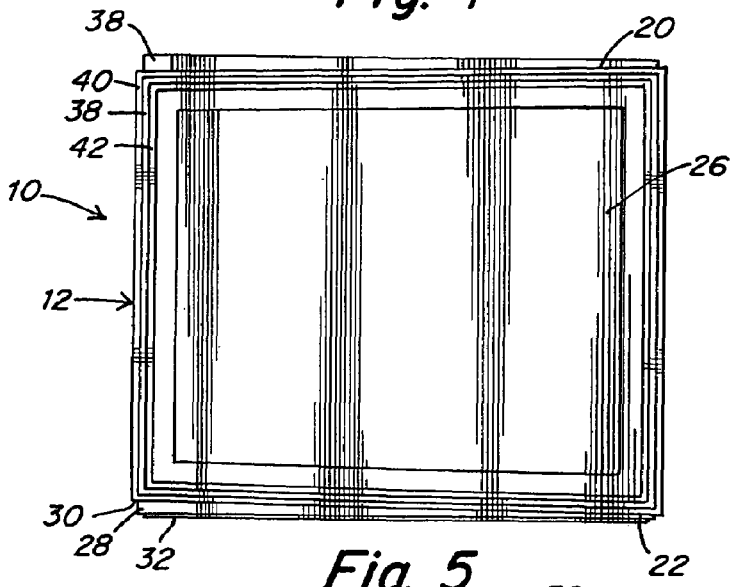
FIG. 5 is a left side elevational view of the bin including the set of dividers shown in FIG. 2.
Figure 6:
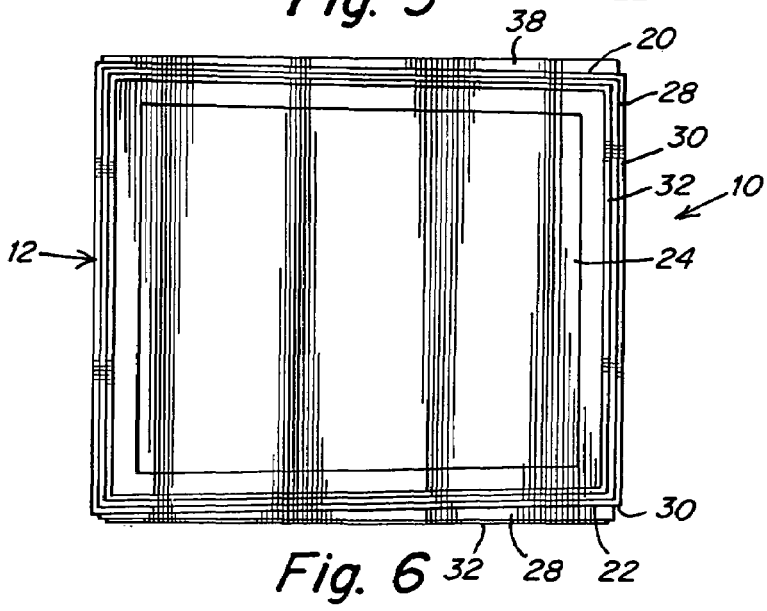
FIG. 6 is a right side elevational view of the bin including the set of dividers shown in FIG. 2.
Figure 7:
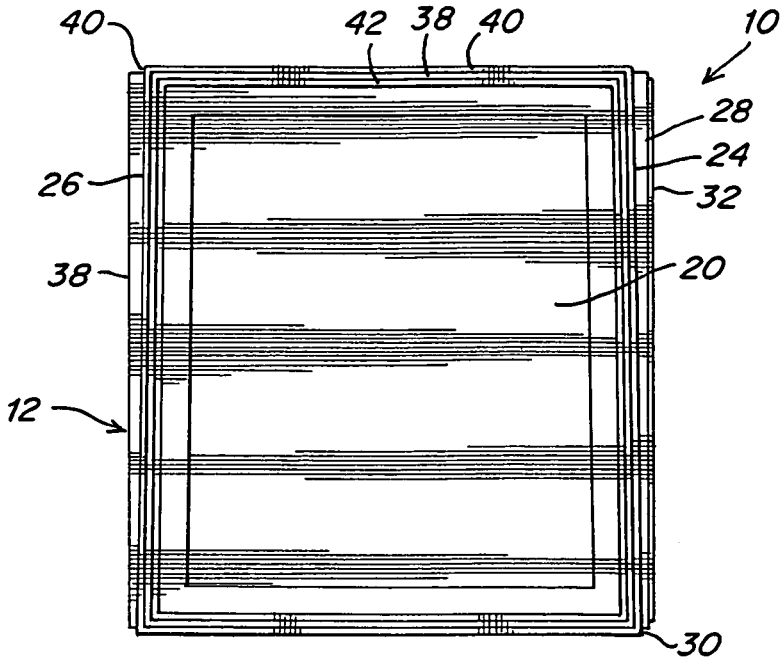
FIG. 7 is a top plan view of the bin including the set of dividers shown in FIG. 2.
Figure 8:
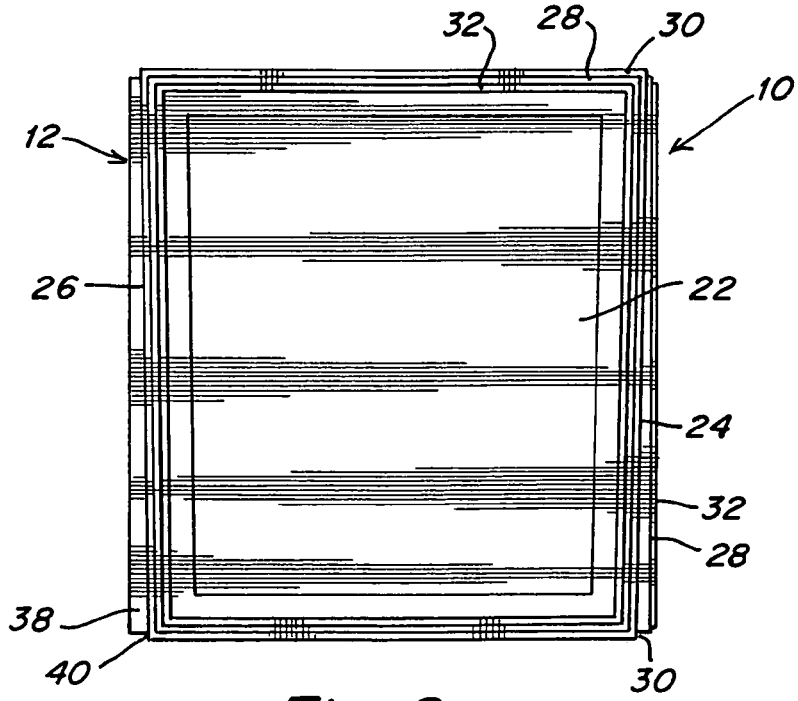
FIG. 8 is a bottom plan view of the bin including the set of dividers shown in FIG. 2.

By providing the dividers 48, 52 with the respective slots 60, 70, the dividers 48, 52 can be mated to another and can both be placed in the receptacle 14 at the same time (see the assembled partitioning structure 16 shown in bin 10A in FIG. 1 and in FIGS. 2 and 3). Specifically, the slot 60 in divider 48 receives a portion of the divider 52 forward of the slot 70 whereas slot 70 in divider 52 receives a portion of the divider 48 rearward of the slot 60.

Also, to aid in proper positioning and secure retention of the dividers 48, 52 together, the divider 52 passes into the channels 68 between the guide members 64 whereas the divider 48 passes into the channels 78 between the guide members 74.

Using vertical divider 48 and horizontal divider 52, there are several ways to partition the receptacle 14 into smaller storage compartments. Specifically, the receptacle 14 has a first configuration with both vertical divider 48 and horizontal divider 52 present therein to thereby define four storage compartments (see bin 10A in FIG. 1), a second configuration with only vertical divider 48 to thereby define two vertically extending storage compartments and a third configuration with only horizontal divider 52 to thereby define two horizontally extending storage compartments (see bin 10B in FIG. 1). Depending on the shape of the bin 10, use of the vertical divider 48 or horizontal divider 52 may provide the same size compartments and by changing the orientation of the bin 10, both configurations described above can be provided with only the vertical divider 48 or the horizontal divider 52. Of course, another configuration is to remove the partitioning structure 16 altogether (see bins 10C and 10D in FIG. 1).

The number of dividers 48, 52 and corresponding sets of divider guides 50, 54 can be varied as desired to partition the receptacle 14 into any number of storage compartments with varying sizes. Slots and guide members would be formed on the dividers and dimensioned and positioned to mate with one another in the same manner as described above.

Additional features of the bin 10 include the presence of recesses on the outer surfaces 30, 40 of the top, bottom and side walls, 20, 22, 24, 26, as well as on the side surfaces of the dividers 48, 52.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A stackable bin, comprising:

a housing defining a receptacle and including two pair of opposed walls defining an opening at a front leading into said receptacle, at least one pair of said opposed walls having inner surfaces having an inward taper along substantially their entire length with respect to a central axis of said housing; and a partitioning structure removably insertable into said receptacle through said opening and partitioning said receptacle into a plurality of storage compartments, said partitioning structure having outer edges having an inward taper along substantially their entire length in correspondence with the inward taper of said inner surfaces of said at least one pair of opposed walls and frictionally engaging said inner surfaces of said at least one pair of opposed walls.

2. The stackable bin of claim 1, wherein a first one of said walls in a pair of said opposed walls has an outward facing stepped profile on an outer surface and a second one of said walls in the same pair of said opposed walls has an inward facing stepped profile on an outer surface which mates with said outward facing stepped profile to thereby enable a plurality of the bins to be mated together via said walls.

3. The stackable bin of claim 2, wherein said outward facing stepped profile includes an outer raised ledge formed on an outer surface of said first wall, said outer raised ledge extending along the entire periphery of said first wall inward from peripheral edges of said first wall, and an inner raised ledge formed on and projecting from said outer raised ledge, said inner raised ledge extending along the entire periphery of said outer raised ledge inward from peripheral edges of said outer raised ledge.

4. The stackable bin of claim 3, wherein said first wall tapers inward such that said outer raised ledge has a variable height along side edges of said first wall and a substantially constant height along front and rear edges of said first wall.

5. The stackable bin of claim 3, wherein said inward facing stepped profile includes a raised ledge formed on an outer surface of said second wall, said raised ledge of said inward facing stepped profile extending along the entire periphery of said second wall inward from peripheral edges of said second wall, and an inwardly facing indentation formed in said raised ledge of said inward facing stepped profile, said indentation extending along the entire periphery of said raised ledge of said inward facing stepped profile inward from peripheral edges of said raised ledge of said inward facing stepped profile.

6. The stackable bin of claim 5, wherein said second wall tapers inward such that said raised ledge of said inward facing stepped profile has a variable height along side edges of said second wall and a substantially constant height along front and rear edges of said second wall.

7. The stackable bin of claim 1, wherein a first wall in each of said two pair of opposed walls has an outward facing stepped profile on an outer surface and a second wall in each of said two pair of opposed walls has an inward facing stepped profile on an outer surface which mates with said outward facing stepped profile to thereby enable a plurality of the bins to be mated together vertically and horizontally via mating of said walls.

8. The stackable bin of claim 1, wherein said partitioning structure includes first and second dividers, said first divider having a slot extending rearward from a front edge and said second divider having a slot extending forward from a rear edge, said first divider being insertable into said slot in said second divider and said second divider being insertable into said slot in said first divider.

9. The stackable bin of claim 8, further comprising guide means for guiding insertion of said dividers into said receptacle.

10. The stackable bin of claim 9, wherein said guide means comprise divider guides arranged on inner surfaces of said walls, each of said divider guides comprising a pair of ribs spaced apart a distance not less than the width of an engaging one of said dividers.

11. The stackable bin of claim 8, wherein said housing includes at least one rear wall section extending between one pair of opposed walls to maintain said partitioning structure in said receptacle, said partitioning structure having a rearward contour which engages with said at least one rear wall section while maintaining a front contour of said partitioning structure flush with front edges of said walls.

12. The stackable bin of claim 8, wherein each of said dividers includes a positioning structure that retains the other of said dividers in a secure position relative thereto, said positioning structure comprising guide members spaced apart from one another to define a channel therebetween which receives the other of said dividers.

13. The stackable bin of claim 8, wherein outer edges of said dividers engaging with said at least one pair of opposed walls are tapered along substantially their entire length in correspondence with the inward tapering of said at least one pair of opposed walls.

14. A stackable bin, comprising:

a housing defining a receptacle and including two pair of opposed walls defining an opening at a front leading into said receptacle, a first wall in each of said two pair of opposed walls having an outward facing stepped profile on an outer surface, and a second wall in each of said two pair of opposed walls having an inward facing stepped profile on an outer surface which mates with said outward facing stepped profile to thereby enable a plurality of the bins to be mated together vertically and horizontally via mating of said walls.

15. The stackable bin of claim 14, wherein each of said walls has an inward taper along at least a portion thereof with respect to a central axis of said housing.

16. The stackable bin of claim 14, further comprising a partitioning structure insertable into said receptacle through said opening and partitioning said receptacle into a plurality of storage compartments.

17. The stackable bin of claim 14, wherein said outward facing stepped profile includes an outer raised ledge formed on an outer surface of said first wall, said outer raised ledge extending along the entire periphery of said first wall inward from peripheral edges of said first wall, and an inner raised ledge formed on and projecting from said outer raised ledge, said inner raised ledge extending along the entire periphery of said outer raised ledge inward from peripheral edges of said outer raised ledge.

18. The stackable bin of claim 14, wherein said inward facing stepped profile includes a raised ledge formed on an outer surface of said second wall, said raised ledge of said inward facing stepped profile extending along the entire periphery of said second wall inward from peripheral edges of said second wall, and an inwardly facing indentation formed in said raised ledge of said inward facing stepped profile, said inwardly facing indentation extending along the entire periphery of said raised ledge of said inward facing stepped profile inward from peripheral edges of said raised ledge of said inward facing stepped profile.

19. A stackable bin, comprising:

a housing defining a receptacle and including a plurality of side walls, said side walls defining an opening at a front end of said side walls and a rear section at a rear end of said side walls opposite said opening, a first one of said side walls having an outward facing stepped profile on an outer surface, said outward facing stepped profile extending along the entire periphery of said first side wall inward from peripheral edges of said first side wall such that said outward facing stepped profile extends alongside said opening, alongside side walls adjacent to said first side wall and alongside said rear section, and a second one of said side walls having an inward facing stepped profile on an outer surface which mates with said outward facing stepped profile to thereby enable a plurality of the bins to be mated together vertically and horizontally via mating of said walls, said inward facing stepped profile extending along the entire periphery of said second side wall inward from peripheral edges of said second side wall such that said inward facing stepped profile extends alongside said opening, alongside side walls adjacent to said second side wall and alongside said rear section.

20. The stackable bin of claim 19, wherein said first and second side walls taper inward from said opening to said rear section such that said outward facing stepped profile has a variable height alongside said side walls adjacent to said first side wall and a substantially constant height alongside said opening and said rear section and such that said inward facing stepped profile has a variable height alongside said side walls adjacent to said second side wall and a substantially constant height alongside said opening and said rear section.

* * * * *